US009663839B2

(12) United States Patent
Joo et al.

(10) Patent No.: US 9,663,839 B2
(45) Date of Patent: May 30, 2017

(54) METHOD FOR MANUFACTURING GRAIN-ORIENTED ELECTRICAL STEEL SHEET HAVING EXCELLENT MAGNETIC PROPERTIES

(75) Inventors: Hyung-Don Joo, Pohang-si (KR); Chang-Soo Kim, Pohang-si (KR); Jong-Tae Park, Pohang-si (KR); Jong-Ho Park, Pohang-si (KR); Byeong-Goo Kim, Pohang-si (KR); Jin-Wook Seo, Pohang-si (KR)

(73) Assignee: POSCO, Gyeonsangbuk-do (KR)

( * ) Notice: Subject to any disclaimer, the term of this patent is extended or adjusted under 35 U.S.C. 154(b) by 630 days.

(21) Appl. No.: 13/979,790

(22) PCT Filed: Dec. 16, 2011

(86) PCT No.: PCT/KR2011/009704

§ 371 (c)(1),
(2), (4) Date: Jul. 15, 2013

(87) PCT Pub. No.: WO2013/089297

PCT Pub. Date: Jun. 20, 2013

(65) Prior Publication Data

US 2013/0306202 A1 Nov. 21, 2013

(51) Int. Cl.

| | |
|---|---|
| ***C21D 8/02*** | (2006.01) |
| ***C21D 8/12*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C21D 6/00*** | (2006.01) |
| ***C22C 1/02*** | (2006.01) |

(52) U.S. Cl.

CPC ..... *C21D 8/0263* (2013.01); *C21D 6/008* (2013.01); *C21D 8/12* (2013.01); *C21D 8/1272* (2013.01); *C21D 9/46* (2013.01); *C22C 1/02* (2013.01); *C22C 38/001* (2013.01); *C22C 38/02* (2013.01); *C22C 38/04* (2013.01); *C22C 38/06* (2013.01)

(58) Field of Classification Search

CPC ..... C21D 8/0263; C21D 6/008; C21D 8/12
See application file for complete search history.

(56) References Cited

U.S. PATENT DOCUMENTS

| | | | | |
|---|---|---|---|---|
| 3,846,187 | A * | 11/1974 | Sakakura | C21D 8/1255 148/111 |
| 4,898,626 | A * | 2/1990 | Shoen | C21D 1/26 148/111 |
| 4,979,997 | A * | 12/1990 | Kobayashi | C21D 8/1255 148/111 |
| 6,613,160 | B2 | 9/2003 | Ushigami et al. | |
| 2009/0126832 | A1 * | 5/2009 | Ushigami | C21D 8/12 148/208 |

FOREIGN PATENT DOCUMENTS

| | | | |
|---|---|---|---|
| EP | 0947597 | A2 | 10/1999 |
| JP | 54047818 | A * | 4/1979 |
| JP | 2000199015 | A | 7/2000 |
| JP | 2002060842 | A | 2/2002 |
| JP | 2002212636 | A | 7/2002 |
| JP | 2003003213 | A | 1/2003 |
| JP | 2008001978 | A | 1/2008 |
| JP | 2008001979 | A | 1/2008 |
| JP | 2008001980 | A | 1/2008 |
| JP | 2008001981 | A | 1/2008 |
| JP | 2008001982 | A | 1/2008 |
| JP | 2008001983 | A | 1/2008 |

* cited by examiner

*Primary Examiner* — Jessee Roe
*Assistant Examiner* — Jenny Wu
(74) *Attorney, Agent, or Firm* — The Webb Law Firm

(57) ABSTRACT

Provided is a method for manufacturing a grain-oriented electrical steel sheet, the method comprising: heating a grain-oriented electrical steel sheet slab; hot-rolling the heated slab; optionally annealing the hot-rolled steel sheet; subjecting the resulting steel sheet to one cold rolling or two or more cold rollings with intermediate annealing therebetween; subjecting the cold-rolled steel sheet to primary recrystallization annealing; and subjecting the annealed steel sheet to secondary recrystallization annealing, wherein the primary recrystallization annealing sequentially comprises an ultra-rapid heating process of heating the steel sheet at an average heating rate of 300° C./sec or higher, a rapid heating process of heating the steel sheet at a lower average heating rate than the average heating rate of the ultra-rapid heating process, but not lower than 100° C./sec, and a general heating process of heating the steel sheet at a lower average heating rate than the average heating rate of the rapid heating process.

20 Claims, No Drawings

METHOD FOR MANUFACTURING GRAIN-ORIENTED ELECTRICAL STEEL SHEET HAVING EXCELLENT MAGNETIC PROPERTIES

CROSS-REFERENCE TO RELATED APPLICATIONS

This application is the United States national phase under 35 U.S.C. §371 of International Application No. PCT/KR2011/009704 filed Dec. 16, 2011, entitled "Method for Manufacturing Grain-Oriented Electrical Steel Sheet Having Excellent Magnetic Properties" the disclosure of which is hereby incorporated by reference in its entirety.

TECHNICAL FIELD

The present invention relates to a method for manufacturing a grain-oriented electrical steel sheet having excellent magnetic properties, and more particularly to a method for manufacturing a grain-oriented electrical steel sheet having excellent magnetic properties as a result of applying a three-stage heating pattern consisting of ultra-rapid heating, rapid heating and general heating to a heating process in primary recrystallization annealing.

BACKGROUND ART

A grain-oriented electrical steel sheet is a soft magnetic material having excellent magnetic properties in the rolling direction as a result of the so-called Goss texture, in which all the grains of the steel are oriented in the {110} direction and the crystallographic orientation in the rolling direction is parallel to the <001> axis.

This grain-oriented electrical steel sheet is manufactured so as to show excellent magnetic properties by secondary recrystallized grains obtained by inhibiting the growth of primary recrystallized grains during final annealing following primary recrystallization and selectively growing grains having the {110}<001> orientation among the inhibited grains. Thus, an inhibitor of growth of the primary recrystallized grains (hereinafter referred to as the "inhibitor") is very important. The key of the technology for manufacturing grain-oriented electrical steel sheets is that grains having the {110}<001> orientation among the inhibited grains can preferentially grow to form secondary recrystallized grains.

Secondary recrystallization in the final annealing process occurs when the inhibitor grows or is degraded with increasing temperature to loss its function to inhibit primary recrystallized grains, and in this case, grain growth occurs within a relatively short time. The growth of all primary recrystallized grains should be inhibited up to immediately before secondary recrystallization in the final annealing process occurs, and for this purpose, precipitates should be uniformly distributed in a sufficient amount and a suitable size, should be thermally stable, and should not be easily decomposed up to a high temperature immediately before second recrystallization occurs.

This {110}<001> texture can be obtained by a combination of various processes. To obtain this texture, the slab composition should be strictly controlled, and the conditions of a series of processes, including slab heating, hot rolling, hot-rolled sheet annealing, cold rolling, primary recrystallization annealing, and final annealing (secondary recrystallization annealing), should be strictly controlled.

As used herein, the term "primary recrystallization" refers to general recrystallization in which new grains are nucleated and grow at a specific temperature or higher. The first recrystallization is generally performed either at the same time as decarburization annealing after cold rolling or immediately after decarburization annealing, and grains having a uniform and suitable size are formed by the first recrystallization. Generally, the orientation of grains in grain-oriented electrical steel sheets are dispersed in several directions, or orientations other than the Goss orientation have textures arranged parallel to the surface orientation, and the ratio of the Goss orientation to be finally obtained in the grain-oriented electrical steel sheets is very low.

As technologies of improving magnetic properties by controlling heating conditions in primary recrystallization annealing, those that use rapid heating in a decarburization annealing process are disclosed in Japanese Patent Laid-Open Publication Nos. 2003-3213, 2008-1978, 2008-1979, 2008-1980, 2008-1981, 2008-1982, and 2008-1983.

Japanese Patent Laid-Open Publication No. 2003-3213 discloses a technology of manufacturing a grain-oriented electrical steel sheet having high magnetic flux density by controlling the amount of nitrification and controlling the ratio of I[111]/I[411] in textures after annealing to 2.5 or less. In addition, it discloses that the amounts of aluminum and nitrogen and the heating rate in the decarburization annealing process should be controlled in order to control the textures.

Japanese Patent Laid-Open Publication Nos. 2008-1978, 2008-1979, 2008-1980, 2008-1981, 2008-1982, and 2008-1983 disclose methods of magnetic flux density by performing decarburization during hot-rolled sheet annealing or controlling the hot-rolled sheet annealing temperature to control the lamellar distance while performing rapid heating in the temperature range of 550~720° C. at 40° C./sec or higher, and preferably 75-125° C./sec, during decarburization annealing. These patent documents disclose that {411}-oriented grains among primary recrystallized grains influence the preferential growth of {110}-oriented secondary recrystallized grains, and that grain-oriented electrical steel sheets are manufactured by controlling the ratio of {111}/{411} in primary recrystallized textures after decarburization annealing to 3.0 or less, performing nitrification and enhancing the inhibitor.

However, in these patent documents, the temperature range in which a great change in the textures is shown is 700~720° C., and only a method of improving magnetic flux density by performing rapid heating to the temperature range of 550~720° C. including the above temperature range (700~720° C.) is suggested.

In addition, these patent documents have technical limitations in that they do not attempt to directly increase the ratio of grains having the Goss orientation, but attempt to increase the ratio of {411}-oriented grains that have an indirect influence on abnormal grain growth (secondary recrystallization) in the Goss orientation in secondary recrystallization annealing after decarburization annealing.

Even when the above prior patent documents are considered together, these patent documents do not suggest a method for manufacturing a grain-oriented electrical steel sheet, in which the magnetic properties of the steel sheet can be improved by controlling the density of Goss orientation in a decarburized sheet through a three-stage heating pattern of ultra-rapid heating+rapid heating+general heating (which means that the heating rate differs between temperature zones) during first recrystallization annealing.

PRIOR ART DOCUMENTS

Patent Documents (Patent document 1) JP2003-3213 A (2003 Jan. 8)
(Patent document 2) JP2008-1978 A (2008 Jan. 10)
(Patent document 3) JP2008-1979 A (2008 Jan. 10)
(Patent document 4) JP2008-1980 A (2008 Jan. 10)
(Patent document 5) JP2008-1981 A (2008 Jan. 10)
(Patent document 6) JP2008-1982 A (2008 Jan. 10)
(Patent document 7) JP2008-1983 A (2008 Jan. 10)

SUMMARY OF THE INVENTION

Accordingly, the present invention has been made in order to solve the above-described problems occurring in the prior art, and an object of the present invention is to provide a novel method for manufacturing a grain-oriented electrical steel sheet in which the magnetic properties of the steel sheet can be improved by increasing the volume fraction of grains having the Goss orientation (particularly the exact Goss orientation) in primary recrystallization annealing using a three-stage heating pattern consisting of ultra-rapid heating, rapid heating and general heating, and increasing the density of crystallographic orientations.

In order to accomplish the above object, the present invention provides a method for manufacturing a grain-oriented electrical steel sheet, the method comprising: providing a grain-oriented electrical steel sheet slab comprising, by wt %, Si: 2.0-4.0%, C: 0.085% or less, acid-soluble Al: 0.015-0.04%, Mn: 0.20% or less, N: 0.010% or less, S: 0.010% or less, and the balance of Fe and inevitable impurities; heating the slab to a temperature of 1280° C. or below; hot-rolling the heated slab; optionally annealing the hot-rolled steel sheet; subjecting the resulting steel sheet to one cold rolling or two or more cold rollings with intermediate annealing therebetween; subjecting the cold-rolled steel sheet to primary recrystallization annealing, and subjecting the annealed steel sheet to secondary recrystallization annealing, wherein the primary recrystallization annealing sequentially comprises an ultra-rapid heating process for heating the steel sheet at an average heating rate of 300° C./sec or higher, a rapid heating process for heating the steel sheet at a lower average heating rate than the average heating rate of the ultra-rapid heating process, but not lower than 100° C./sec, and a general heating process for heating the steel sheet at a lower average heating rate than the average heating rate of the rapid heating process.

The ultra-rapid heating process is performed by heating the steel sheet at an average heating rate of 300° C./sec or higher from room temperature to Ts (° C.), which is a temperature of 500~600° C. before recrystallization, the rapid heating process is performed by heating the steel sheet at an average heating rate of 100~250° C./sec from Ts (° C.) to 700° C., and the general heating process is performed by heating the steel sheet at an average heating rate of 40° C./sec or lower from 700° C. to the decarburization annealing temperature.

In the method of the present invention, the number of grains having a size of 35 μm or larger, measured when observing the cross-section of the steel sheet after the primary recrystallization annealing but before the secondary recrystallization annealing, is less than 30.

In addition, in the method of the present invention, the volume fraction of grains having an orientation of up to 15° from the {110}<001> orientation is 2% or more when measured in a layer corresponding to ⅛ of the thickness from the surface of the steel sheet after primary recrystallization annealing but before secondary recrystallization annealing, and the volume fraction of grains having an orientation of up to 5° from the {110}<001> orientation is 0.09% or more when measured under the above conditions.

In addition, in the inventive method for manufacturing the grain-oriented electrical steel sheet, a β angle as the area-weighted average of the absolute value of crystallographic orientation, measured for the steel sheet after secondary recrystallization annealing, is controlled in the range of 1.5-2.6°, and a δ angle is controlled to 5° or less. Herein, the β angle is an average angle of deviation from the {110}<001> orientation in the direction perpendicular to the rolling direction of the secondary recrystallized texture, and the δ angle is an average angle of deviation between the <001> orientation and the rolling direction in the secondary recrystallized texture.

In the inventive method for manufacturing the grain-oriented electrical steel sheet, the heating process in primary recrystallization annealing may be controlled to a three-stage pattern using a plurality of inducing heating furnaces.

According to the present invention, a grain-oriented electrical steel sheet having high magnetic flux density and low core loss can be manufactured by using a three-stage heating pattern (ultra-rapid heating+rapid heating+general heating) in primary recrystallization annealing to increase the volume fraction of Goss orientation (particularly exact Goss orientation) in the primary recrystallized steel sheet to thereby increase the density of crystallographic orientations.

DETAILED DESCRIPTION OF THE INVENTION

Hereinafter, the inventive method for manufacturing a grain-oriented electrical steel sheet will be described in detail.

The present inventors conducted studies on nucleation in primary recrystallization of a grain-oriented electrical steel sheet, particularly the behavior in primary recrystallization of grains having Goss orientation ({110}<001>) that can grow into nuclei in secondary recrystallization. As a result, the present inventors could infer that the nucleation of Goss-oriented grains occurs in the shear band on which strain energy is concentrated during primary recrystallization after receiving a strong strain, the accumulated strain energy of the shear band partially decreases by recovery in a heating region during primary recrystallization annealing, and thus the nucleation sites of Goss-oriented grains decrease.

Based on this inference, the present inventors conducted studies and experiments on the heating conditions in primary recrystallization annealing, which can minimize the decrease in the accumulated strain energy of the shear band, which is caused by recovery, to increase the nucleation of Goss-oriented grains. As a result, the present inventors could first find that the volume fraction of Goss orientation, particularly exact Goss orientation, can be significantly increased by performing first recrystallization annealing using a three-stage heating pattern consisting of two-stage rapid heating (ultra-raid heating+rapid heating) and general heating, in which the two-stage heating includes an ultra-rapid heating process of performing heating in a specific temperature region at a much higher rate than conventional rate.

The present invention provides a method for manufacturing a grain-oriented electrical steel sheet, the method comprising: heating a grain-oriented electrical steel sheet slab comprising, by wt %, Si: 2.0-4.0%, C: 0.085% or less, acid-soluble Al: 0.015-0.04%, Mn: 0.20% or less, N: 0.010% or less, S: 0.010% or less, and the balance of Fe and inevitable impurities; heating the slab; hot-rolling the heated slab; optionally annealing the hot-rolled steel sheet; subjecting the resulting steel sheet to one cold rolling or two or more cold rollings with intermediate annealing therebetween; subjecting the cold-rolled steel sheet to primary recrystallization annealing, and subjecting the annealed steel sheet to secondary recrystallization annealing, wherein the primary recrystallization annealing employs a three-stage heating pattern consisting of ultra-rapid heating, rapid heating and general heating, in which the ultra-rapid heating process is performed by heating the steel sheet at an average heating rate of 300° C./sec or higher in a region from room temperature to Ts (° C.), which is a temperature of 500~600° C. before recrystallization, the rapid heating process is performed by heating the steel sheet at an average heating rate of 100~250° C./sec in a region ranging from Ts (° C.) to 700° C., and the general heating process is performed by heating the steel sheet at an average heating rate of 40° C./sec or lower in a range ranging from 700° C. to the decarburization annealing temperature.

According to the present invention, a novel three-stage heating pattern (ultra-rapid heating+rapid heating+general heating) is applied in primary recrystallization annealing. Specifically, the steel sheet is heated from room temperature to the pre-recrystallization temperature (500~600° C.) at a rate of 300° C./sec or higher, and then heated at a rate of 100~250° C./sec, whereby the decrease (i.e., recovery) in the strain energy of Goss oriented grains in the shear band can be minimized to maximize the nucleation of Goss-oriented grains to thereby form good recrystallized grains.

The above-described Ts (° C.) is a temperature at which the ultra-rapid heating process is converted to the rapid heating process. Because recrystallization is initiated at a temperature of about 550~600° C., Ts is preferably 500~600° C., and more preferably 550~600° C., and is preferably the recrystallization initiation temperature or lower.

As used herein, the term "room temperature" refers to the temperature of the steel sheet at a time point when the heating process in primary recrystallization annealing is initiated.

In addition, the present invention was completed based on a new finding that the fraction of exact Goss-oriented grains as seeds capable of causing secondary recrystallization can be increased by the ultra-rapid heating process to below the recrystallization temperature in primary recrystallization annealing, so that the nucleation of very highly dense Goss-oriented grains can be induced, thereby maximizing the effect of improving magnetic properties.

When a conventional heating pattern consisting of rapid heating followed by general heating is applied in primary recrystallization annealing, the volume fraction of orientation, which is in 15° from the {110}<001> orientation, is only about 1%. Unlike this, according to the present invention, when primary recrystallization annealing is performed by rapidly heating the steel sheet from room temperature to about 550° C. or lower at a rate of 300° C./sec or higher (preferably 400° C./sec or higher), rapidly heating the steel sheet from 570° C. or lower to 700° C. at a rate of 100~250° C./sec (more preferably 120~180° C./sec or higher), and generally heating the steel sheet from 700° C. or higher to the decarburization annealing temperature at a rate of 40° C./sec or lower, the volume fraction of grains having an orientation of 15° or less from the {110}<001> orientation can be controlled to 2% or more, and particularly, the volume fraction of exact Goss grains having an orientation of 5° or less from the {110}<001> orientation can be controlled to 0.09% or more.

The present inventors measured the volume fraction of grains, which are in the range of 5°, 10° and 15° from the {110}<001> orientation, in a layer corresponding to ⅛ of the thickness from the surface of a sample (at least 95% recrystallized) immediately after rapid heating in primary recrystallization annealing. As a result, it was observed that the total Goss orientation was increased during rapid annealing, and the fraction of exact Goss orientation, which is in 5° from the {110}<001> orientation in recrystallized grains formed by ultra-rapid heating+rapid heating+general heating, was maximized.

As described above, when the rate of increase in the exact Goss orientation closer to the {110}<001> orientation in primary recrystallized structures is higher than the rate of increase in orientations far from the {110}<001> orientation, the exact Goss orientation acts as nuclei in secondary recrystallization to directly increase the density of Goss-oriented grains that grow into secondary recrystallized grains, thereby significantly improving the magnetic flux density and core loss properties of the steel sheet.

However, if the rate of the rapid heating after the ultra-rapid heating is excessively high, the magnetic properties are deteriorated rather than improved. This is believed to be attributable to the following reasons. When two-stage rapid heating (ultra-rapid heating+rapid heating) is applied in primary recrystallization, the size distribution of grains is uniform up to a specific heating rate, but if the rate of heating from Ts (° C.) to 700° C. is higher than 250° C./sec, the uniformity of grains will increase so that the fraction of grains having a size larger than 35 μm will excessively increase and grains having undesired orientation will grow due to the grain growth caused by the size advantage, and thus the magnetic properties will be deteriorated rather than improved.

In addition, Goss-oriented grains have the highest strain energy and thus are first recrystallized, and then grains having the {111}<112> orientation and the {411}<148> orientation are recrystallized. After Goss-oriented grains have been first recrystallized, the fraction of orientations such as {111}<112> and {411}<148> gradually increases during grain growth, and the growth of orientations such as {111}<112> and {411}<148> can reduce the growth of Goss-oriented grains during primary recrystallization. For this reason, the rate of heating from 700° C. or higher needs to be increased, and the rate of heating from 680° C. or higher is preferably 40° C./sec or lower.

Thus, in order to effectively improve the magnetic properties by increasing the fraction of Goss-oriented grains, heating in primary recrystallization annealing is performed by ultra-rapidly heating the steel sheet from room temperature to Ts at an average heating rate of 300° C./sec or higher, then rapidly heating the steel sheet to 700° C. at an average heating rate of 100~250° C./sec, and then heating the steel sheet from 700° C. or higher at an average heating rate of 40° C./sec or lower.

Furthermore, the present inventors measured the area-weighted average of angles deviating from the {110}<001> orientation of secondary recrystallized grains in a sample using the three-stage heating pattern in primary recrystallization annealing. The main characteristics of the device used in the measurement are as follows. The measurement was performed using an X-ray CCD detector based on the X-ray Laue method. The positions of X-ray diffraction in the CCD detector and the specimen and the slanted angle of the detector were controlled in a unit of 1 μm, and the analysis of orientation strain of single crystal was used, thereby increasing the accuracy of measurement. The orientation at each position of the specimen was measured while moving the sample, and the absolute angle of deviation of the measured orientation from ideal Goss orientation was calculated. Then, the area-weighted average of the angles at all the positions was calculated to determine the area-weighted average of the absolute values of the deviation angles.

The deviation angles were measured for four angles, an α angle, a β angle, a γ angle, and a δ angle. The α angle is defined as the average deviation angle from the {110}<001> orientation in the normal direction (ND) of a secondary recrystallized texture; the β angle is defined as the average deviation angle from the {110}<001> orientation in the transverse direction (TD) of a secondary recrystallized texture; the γ angle is defined as the average deviation angle from the {110}<001> orientation in the rolling direction (RD) of a secondary recrystallized texture; and the δ angle is defined as the average deviation angle between the <001> orientation and rolling direction (RD) of a secondary recrystallized texture.

The results of the measurement showed that, when the two-stage rapid heating consisting of ultra-rapid heating and rapid heating as described in the present invention was applied in primary recrystallization annealing, all the deviation angles were reduced. Particularly, the β angle was close to 2°, and the δ angle was also rapidly reduced. When the β angle is close to 2°, the magnetic domain width is reduced to minimize electromagnetic energy, and the disclosure magnetic domain is reduced to improve magnetic properties.

According to the inventive method for manufacturing the grain-oriented electrical steel sheet as described above, the area weighted average of the absolute value of the β angle, measured for a steel sheet after secondary recrystallization annealing, can be controlled in the range of 1.5-2.6°, and preferably 1.5-2.4°, and the area weighted average of the absolute value of the δ angle can be controlled to 5° or less, and preferably 4.5° or less.

Hereinafter, the reasons for the limitation of the components of the grain-oriented electrical steel sheet that is used in the present invention will be described.

Si serves to increase the resistivity of the grain-oriented electrical street sheet to reduce the core loss. If the content of Si is less than 2.0 wt %, the resistivity will decrease to increase the core loss, and if the content of Si is more than 4.0 wt %, the brittleness of the steel will increase to make cold rolling difficult, and the formation of secondary recrystallized grains becomes unstable. For these reasons, the content of Si is limited to 2.0-4.0 wt %.

Al is finally converted into nitrides such as AlN and (Al,Si,Mn)N, which act as inhibitors. If the content of Al is less than 0.015 wt %, it cannot show a sufficient inhibitor effect, and if the content of Al is excessively high, it will adversely affect hot-rolling operation. For these reasons, the content of Al is limited to 0.015-0.04 wt %.

Mn has the effect of increasing the resistivity to reduce the core loss, like Si. Also, Mn reacts with nitrogen, which is introduced for nitrification together with Si, to form a precipitate of (Al,Si,Mn)N, and thus plays an important role in inducing secondary recrystallization by inhibiting the growth of primary recrystallized grains. However, if it is added in an amount of more than 0.20 wt %, it will promote austenite phase transformation during hot rolling to reduce the size of primary recrystallized grains, and thus secondary recrystallized grains become unstable. For these reasons, the content of Mn is limited to 0.20 wt % or less.

When C is added in a suitable amount, it promotes the austenite transformation of the steel to refine the hot-rolled structure during hot rolling, thus facilitating the formation of uniform microstructures. However, if the content thereof is excessively high, coarse carbides will precipitate, and removal of carbon during decarburization will be difficult. For these reasons, the content of C is 0.085 wt % or less.

N is an element that reacts with Al and the like to refine grains. When this element is suitably distributed, it can suitably refine structures after cold rolling as described above to make it easy to ensure primary recrystallized grains having a suitable grain size. However, if the content thereof is excessively high, primary recrystallized grains will be excessively refined, and thus a driving force for grain growth in secondary recrystallization will increase due to fine grains so that grains having undesirable orientations can also grow. Also, if the content of N is more than 0.010 wt %, the temperature of initiation of secondary recrystallization will increase to deteriorate the magnetic properties of the steel sheet. For these reasons, the content of N is limited to 0.010 wt % or less. When a treatment for increasing the amount of nitrogen is performed between cold rolling and secondary recrystallization annealing, the content of N in the slab may also be 0.006% or less.

S is an element that has a high solid-solution temperature and severely segregates, and the content thereof is preferably reduced to the lowest possible level, but it is a kind of inevitable impurity that is incorporated during steel making. In addition, S forms MnS that affects the size of primary recrystallized grains. For this reason, the content of S is limited to 0.010 wt % or less, and preferably 0.006 wt %.

Any person skilled in the art will appreciate that, in addition to the above components, various components that are contained in grain-oriented electrical steel sheets may be used as alloying elements in the electrical steel sheet of the present invention. A combination of conventionally known components and the application thereof fall within the scope of the present invention.

Hereinafter, a method for manufacturing a grain-oriented electrical steel sheet having excellent magnetic properties using a grain-oriented electrical steel sheet slab having the above-described composition will be described in detail.

A grain-oriented electrical steel sheet having the above-described composition is reheated before hot rolling. Herein, the slab is preferably heated to 1280° C. or lower, and more preferably 1200° C. or lower, in order to partially dissolve precipitates. This is because if the slab heating temperature increases, the production cost of the steel sheet increases and the surface portion of the slab can be melted to reduce the service life of a heating furnace. Particularly, when the slab is heated to 1200° C. or lower, the columnar structure of the slab can be prevented from growing coarsely, and cracking can be prevented from occurring in the width direction of the sheet in a subsequent hot-rolling process, thereby increasing yield.

After the grain-oriented electrical steel sheet has been reheated, it is hot-rolled. In the hot-rolling process, a hot-rolled steel sheet having a thickness of 2.0-3.5 mm can be produced. The produced hot-rolled steel sheet may, if necessary, be annealed, and then is cold-rolled. If the hot-rolled steel sheet is annealed, it may be heated to 1000~1250° C., and then homogenized at a temperature of 850~1000° C., followed by cooling. The annealing of the hot-rolled steel sheet is optionally performed and may also be omitted.

The cold rolling may be performed by subjecting the steel sheet either to one cold rolling or to two cold rollings with intermediate annealing therebetween. The cold rolled steel sheet may have a final thickness of 0.1-0.5 mm, and preferably 0.18-0.35 mm.

The cold-rolled steel sheet is then subjected to primary recrystallization annealing. As described above, according to the present invention, ultra-rapid heating is introduced in the heating process during primary recrystallization annealing. Specifically, a three-stage heating pattern consisting of ultra-rapid heating, rapid heating and general heating is applied in the heating process during primary recrystallization annealing.

In the ultra-rapid heating process of the three-stage heating pattern, the steel sheet is heated from room temperature to a temperature between 500 and 600° C., preferably a temperature (Ts) 550° C. and 600° C., at an average heating rate of 300° C./sec or higher. In the rapid heating process, the steel sheet is heated from the temperature (Ts) to 700° C. at an average heating rate of 100~250° C./sec. Then, the steel sheet is heated from 700° C. or higher at an average heating rate of 40° C./sec or lower. In this manner, the magnetic properties of the grain-oriented electrical steel sheet can be improved, and the reasons therefor are as described above.

The method for heating in primary recrystallization annealing is not specifically limited, may be performed using an induction heating furnace or may be performed in a three-stage heating pattern using a plurality of induction heating furnaces. For example, it may be performed by ultra-rapidly heating the steel sheet in a first induction heating furnace as a rate of 300° C./sec or higher, and preferably 400° C./sec or higher, rapidly heating the steel sheet in a second induction heating furnace at a rate of 100~250° C./sec, and more preferably 120~180° C./sec, and generally heating the steel sheet in a third induction heating furnace at a rate of 40° C./sec or lower.

In the primary recrystallization annealing, the heated steel sheet is subjected to decarburization and nitrification annealing. The nitrification annealing may be performed after or simultaneously with decarburization.

If nitrification annealing is performed simultaneously with decarburization, it may be performed in a mixed gas atmosphere of ammonia, hydrogen and nitrogen. If decarburization is first performed after the heating process in the primary recrystallization annealing, and then nitrification annealing is performed, precipitates such as $Si_3N_4$ or (Si, Mn)N are formed on the surface layer of the steel sheet, and such precipitates are thermally unstable and thus easily decomposed, and the diffusion of nitrogen also occurs very fast. For these reasons, in this case, the temperature of the nitrification annealing should be controlled at 700~800° C., and precipitates such as thermally stable AlN or (Al,Si, Mn)N should be formed in the final annealing process so that they can act as inhibitors. Unlike this, when decarburization and nitrification annealing are simultaneously performed, there is an advantage in that precipitates such as AlN or (Al,Si,Mn)N are simultaneously formed, and thus these precipitates can be used as inhibitors in the final annealing process without having to transform these precipitates so that a long treatment time is not required. Accordingly, it is more preferable to perform decarburization and nitrification annealing at the same time.

However, the inventive method for manufacturing the grain-oriented electrical steel sheet is not limited to simultaneous decarburization and nitrification annealing during the first recrystallization annealing, and performing nitrification annealing after decarburization is also effective in manufacturing the inventive grain-oriented electrical steel sheet having advantageous properties.

After an annealing separator has been applied to the primary recrystallized steel sheet, the steel sheet is subjected to final annealing to cause secondary recrystallization, so that a {110}<001> texture is formed in which the {110} plane is parallel to the rolling plane and the <001> direction is parallel to the rolling direction. The annealing separator that is used herein is preferably based on MgO, but is not limited thereto.

The purposes of the final annealing are generally to form a {110}<001> texture by secondary recrystallization and to impart insulating properties by forming a glassy layer by the reaction of MgO with an oxide layer formed during decarburization, and also to remove impurities that adversely affect magnetic properties. In the final annealing process, in the heating zone before secondary recrystallization occurs, the steel sheet is maintained in a mixed gas atmosphere of nitrogen and hydrogen so that secondary recrystallized grains are well developed by protecting the grain growth inhibitor nitride, and after the completion of secondary recrystallization, the steel sheet is maintained in a 100% hydrogen atmosphere so that impurities are removed.

Hereinafter, the present invention will be described in further detail with reference to examples.

EXAMPLE 1

A grain-oriented electrical steel sheet slab comprising, by wt %, Si: 3.18%, C: 0.056%, Mn: 0.09%, S: 0.0054%, N: 0.0051%, soluble Al: 0.028%, and the balance of Fe and inevitable impurities, was heated at a temperature of 1150° C. for 210 minutes, and then hot-rolled to manufacture a hot-rolled steel sheet having a thickness of 2.3 mm. The hot-rolled steel sheet was heated to a temperature of 1100° C. or higher, maintained at 910° C. for 90 seconds, quenched in water, pickled, and then cold-rolled to a thickness of 0.30 mm.

The cold-rolled steel sheet was heated in the furnace, and then subjected to simultaneous decarburization and nitrification by maintaining the steel sheet at a temperature of 845° C. for 160 seconds in a mixed gas atmosphere formed by simultaneously adding 74.5% hydrogen, 24.5% nitrogen and 1% dry ammonia gas and having a dew-point temperature of 65° C. The nitrogen content of the nitrified steel sheet was controlled between 170 ppm and 210 ppm. In the heating process, the steel sheet was heated from room temperature to 570° C. at various heating rates of 30° C./sec, 110° C./sec, 420° C./sec and 560° C./sec, and then from 570° C. to 700° C. at various heating rates of 30° C./sec, 70° C./sec, 110° C./sec, 140° C./sec, 190° C./sec, 270° C./sec and 350° C./sec, and then from 700° C. to 845° C. (decarburization annealing temperature) at a rate of 30° C./sec.

The annealing separator MgO was applied to the steel sheet which was then subjected to final annealing in a coiled state. In the final annealing, the steel sheet was maintained in a mixed atmosphere of 25% nitrogen+75% hydrogen until it reached 1200° C., and after the steel sheet reached 1200° C., it was maintained in a 100% hydrogen atmosphere for 10 hours or more, and then cooled in the furnace. Magnetic properties measured for each condition are shown in Table 1 below.

TABLE 1

| Rate of heating from room temperature to 570° C. (° C./sec) | Rate of heating from 570 to 700° C. (° C./sec) | Rate of heating from 700 to 845° C. (° C./sec) | Magnetic flux density ($B_{10}$, Tesla) | Core loss ($W_{17/50}$, W/kg) | Remarks |
|---|---|---|---|---|---|
| 30 | 30 | 30 | 1.88 | 1.04 | Comparative material 1 |
| 30 | 140 | 30 | 1.92 | 0.96 | Comparative material 2 |
| 30 | 270 | 30 | 1.91 | 0.97 | Comparative material 3 |
| 30 | 350 | 30 | 1.90 | 1.00 | Comparative material 4 |
| 420 | 30 | 30 | 1.91 | 1.01 | Comparative material 5 |
| 420 | 70 | 30 | 1.91 | 0.98 | Comparative material 6 |
| 420 | 110 | 30 | 1.95 | 0.92 | Inventive material 1 |
| 420 | 140 | 30 | 1.96 | 0.90 | Inventive material 2 |
| 420 | 190 | 30 | 1.96 | 0.91 | Inventive material 3 |
| 420 | 270 | 30 | 1.92 | 0.97 | Comparative material 7 |
| 420 | 350 | 30 | 1.91 | 0.99 | Comparative material 8 |
| 560 | 30 | 30 | 1.91 | 1.00 | Comparative material 9 |
| 560 | 70 | 30 | 1.92 | 0.97 | Comparative material 10 |
| 560 | 110 | 30 | 1.94 | 0.92 | Inventive material 4 |
| 560 | 140 | 30 | 1.97 | 0.89 | Inventive material 5 |
| 560 | 190 | 30 | 1.96 | 0.91 | Inventive material 6 |
| 560 | 270 | 30 | 1.92 | 0.98 | Comparative material 11 |
| 560 | 350 | 30 | 1.91 | 1.00 | Comparative material 12 |
| 110 | 110 | 30 | 1.92 | 0.98 | Comparative material 13 |

As can be seen in Table 1 above, comparative materials 1 to 4, which were generally heated from room temperature to 570° C. at a rate of 30° C./sec, had low magnetic flux density and high core loss compared to the steel sheets which were ultra-rapidly heated.

In addition, comparative material 13 which was subjected to first stage rapid heating (two-stage heating pattern) by heating the steel sheet from room temperature to 700° C. at a rate of 110° C./sec in primary recrystallization, showed a lower magnetic flux density of 1.92 Tesla and a higher core loss of 0.98 W/kg than those of inventive materials 1 to 6.

On the contrary, it was shown that inventive materials 1 to 6 subjected to a three-stage heating pattern comprising two-stage heating (ultra-rapid heating+rapid heating) conditions during primary recrystallization showed a high magnetic flux density of 1.94-1.97 Tesla and a low core loss of 0.89-0.91 W/kg.

EXAMPLE 2

A grain-oriented electrical steel sheet slab comprising, by wt %, Si: 3.25%, C: 0.048%, Mn: 0.07%, S: 0.005%, N: 0.0045%, soluble Al: 0.027%, and the balance of Fe and inevitable impurities, was heated at 1150° C. for 210 minutes, and then hot-rolled to produce hot-rolled steel sheets having thicknesses of 1.7 mm, 2.0 mm and 2.3 mm. These hot-rolled steel sheets were heated to a temperature of 1100° C. or higher, maintained at 910° C. for 90 seconds, quenched in water, pickled, and then cold-rolled to thicknesses of 0.23 mm, 0.27 mm and 0.30 mm.

The cold-rolled steel sheets were heated in the furnace, and then subjected to simultaneous decarburization and nitrification by maintaining the steel sheets at a temperature of 845° C. for 160 seconds in a mixed gas atmosphere formed by simultaneously adding 74.5% hydrogen, 24.5% nitrogen and 1% dry ammonia gas and having a dew-point temperature of 65° C. The nitrogen content of the nitrified steel sheets was controlled between 170 ppm and 210 ppm. In the heating process, each steel sheet was heated from room temperature to 570° C. at rates of 30° C./sec, 140° C./sec, 160° C./sec and 560° C./sec, and from 570 to 700° C. at rates of 30° C./sec, 140° C./sec and 350° C./sec. Then, the steel sheets were heated from 700° C. to 845° C. (decarburization annealing temperature) at a rate of 25° C./sec.

The annealing separator MgO was applied to each steel sheet which was then subjected to final annealing in a coiled state. In the final annealing, the steel sheet was maintained in a mixed atmosphere of 25% nitrogen+75% hydrogen until it reached 1200° C., and after each steel sheet reached 1200° C., it was maintained in a 100% hydrogen atmosphere for 10 hours or more, and then cooled in the furnace. Magnetic properties measured for each condition are shown in Table 2 below.

TABLE 2

| Thickness (mm) of hot-rolled steel sheet | Thickness (mm) of cold-rolled steel sheet | Rate of heating from room temperature to 570° C. (° C./sec) | Rate of heating from 570 to 700° C. (° C./sec) | Magnetic flux density ($B_{10}$, Tesla) | Core loss ($W_{17/50}$, W/kg) | Remarks |
|---|---|---|---|---|---|---|
| 1.7 | 0.23 | 30 | 30 | 1.91 | 0.90 | Comparative material 14 |
| 1.7 | 0.23 | 140 | 140 | 1.93 | 0.86 | Comparative material 15 |
| 1.7 | 0.23 | 560 | 30 | 1.92 | 0.88 | Comparative material16 |
| 1.7 | 0.23 | 560 | 140 | 1.96 | 0.75 | Inventive material 7 |
| 1.7 | 0.23 | 560 | 350 | 1.92 | 0.88 | Comparative material 17 |
| 2.0 | 0.27 | 30 | 30 | 1.91 | 0.96 | Comparative material 18 |
| 2.0 | 0.27 | 160 | 140 | 1.93 | 0.90 | Comparative material 19 |
| 2.0 | 0.27 | 560 | 30 | 1.91 | 0.95 | Comparative material 20 |
| 2.0 | 0.27 | 560 | 140 | 1.96 | 0.85 | Inventive material 8 |
| 2.0 | 0.27 | 560 | 350 | 1.93 | 0.93 | Comparative material21 |
| 2.3 | 0.30 | 30 | 30 | 1.89 | 1.03 | Comparative material 22 |
| 2.3 | 0.30 | 140 | 140 | 1.93 | 0.96 | Comparative material 23 |
| 2.3 | 0.30 | 560 | 30 | 1.91 | 1.00 | Comparative material 24 |
| 2.3 | 0.30 | 560 | 140 | 1.96 | 0.96 | Inventive material 9 |
| 2.3 | 0.30 | 560 | 350 | 1.92 | 0.97 | Comparative material 25 |

As can be seen in Table 2 above, when the thicknesses of the cold-rolled steel sheets were 0.23 mm, 0.27 mm and 0.30 mm, inventive materials 7 to 9 subjected to the heating pattern comprising ultra-rapid heating followed by rapid heating all showed excellent magnetic properties.

On the contrary, comparative materials 14, 18 and 22, which were generally heated from room temperature to 570° C. at a rate of 30° C./sec, and comparative materials 15, 19 and 23 subjected to one-stage rapid heating (two-stage heating pattern) by heating from room temperature to 700° C. at a rate of 140~160° C./sec, showed inferior magnetic properties compared to inventive materials 7 to 9 subjected to ultra-rapid heating followed by rapid heating.

EXAMPLE 3

A grain-oriented electrical steel sheet slab comprising, by wt %, Si: 3.25%, C: 0.052%, Mn: 0.105%, S: 0.0049%, N: 0.0048%, soluble Al: 0.028%, and the balance of Fe and inevitable impurities, were heated at a temperature of 1150° C. for 210 hours, and then hot-rolled to produce a hot-rolled steel sheet having a thickness of 2.3 mm. The hot-rolled steel sheet was heated to a temperature of 1100° C. or higher, maintained at 910° C. for 90 seconds, quenched in water, pickled, and then cold-rolled to a thickness of 0.30 mm.

The cold-rolled steel sheet was heated in the furnace, and then subjected to simultaneous decarburization and nitrification by maintaining the steel sheet at a temperature of 845° C. for 160 seconds in a mixed gas atmosphere formed by simultaneously adding 74.5% hydrogen, 24.5% nitrogen and 1% dry ammonia gas and having a dew-point temperature of 65° C. The nitrogen content of the nitrified steel sheet was controlled between 170 ppm and 210 ppm.

In the heating process, the steel sheet was heated from room temperature to 570° C. at rates of 30° C./sec, 110° C./sec and 560° C./sec, and then from 570° C. to 700° C. at rates of 30° C./sec, 110° C./sec, 140° C./sec, 190° C./sec and 350° C./sec, and then 700° C. to 845° C. (decarburization annealing temperature) at a rate of 25° C./sec.

The annealing separator MgO was applied to the steel sheet which was then subjected to final annealing in a coiled state. In the final annealing, the steel sheet was maintained in a mixed atmosphere of 25% nitrogen+75% hydrogen until it reached 1200° C., and after the steel sheet reached 1200° C., it was maintained in a 100% hydrogen atmosphere for 10 hours or more, and then cooled in the furnace. Magnetic properties measured for each condition are shown in Table 3 below.

The fraction of Goss-oriented grains in a layer corresponding to ⅛ of the thickness from the surface of the decarburized steel sheet was measured at deviation angles of up to 5° and 15° from the {110}<001> orientation. In addition, the number of grains having a size of 35 μm in a cross-section perpendicular to the rolling direction of the decarburized steel sheet was measured, and the fraction of grains having an orientation of up to 15° from the {411}<148> orientation was measured. The results of the measurement are shown in Table 3 below. Herein, the size of grains was expressed as the average between the longest length and the shortest length.

TABLE 3

| Rate of heating from room temperature to 570° C. (° C./sec) | Rate of heating from 570 to 700° C. (° C./sec) | Magnetic flux density ($B_{10}$, Tesla) | Core loss ($W_{17/50}$, W/kg) | Number of coarse grains (35 μm or more) | Fraction (%) of up to 15° from {411}<148> | Fraction of Goss orientation: Up to 15° — Fraction (%) of orientation | Up to 15° — Ratio of increase compared to comparative material 26 | Up to 5° (Exact goss) — Fraction (%) of orientation | Up to 5° (Exact goss) — Ratio of increase compared to comparative material 26 | Remarks |
|---|---|---|---|---|---|---|---|---|---|---|
| 30 | 30 | 1.88 | 1.04 | 40 | 14.9 | 1.75 | — | 0.07 | — | Comparative material 26 |
| 30 | 140 | 1.93 | 0.96 | 38 | 15.2 | 1.87 | 6.9 | 0.08 | 14.3 | Comparative material 27 |
| 30 | 350 | 1.91 | 0.99 | 42 | 14.5 | 1.92 | 9.7 | 0.08 | 14.3 | Comparative material 28 |
| 560 | 30 | 1.91 | 0.99 | 35 | 14.8 | 1.85 | 5.7 | 0.08 | 14.3 | Comparative material 29 |
| 560 | 140 | 1.97 | 0.89 | 22 | 14.7 | 2.18 | 24.6 | 0.13 | 85.7 | Inventive material 10 |
| 560 | 190 | 1.95 | 0.91 | 27 | 16.0 | 234 | 33.7 | 0.12 | 71.4 | Inventive material 11 |
| 560 | 350 | 1.92 | 0.97 | 42 | 16.0 | 234 | 33.7 | 0.12 | 71.4 | Comparative material30 |
| 110 | 110 | 1.92 | 0.97 | 41 | 15.1 | 1.91 | 9.1 | 0.08 | 14.3 | Comparative material 31 |

As can be seen in Table 3 above, comparative material 29, which was heated at a high rate only in the temperature range from room temperature to 570° C., comparative materials 27 and 28, which were heated at a high rate only in the temperature range from 570 to 700° C., and comparative material 31 which was heated at a high rate in both the temperature range from room temperature to 570° C. and the temperature range from 570 to 700° C., all showed a somewhat increase in the fraction of Goss-oriented grains compared to comparative material 26 which was heated at a slow rate in primary recrystallization, but an increase in the fraction of exact Goss grains having an orientation of up to 5° from the {110}<001> orientation was as low as 14.3%. This could be explained by the fact that there was no great change in the fraction of grains having the {411}<148> orientation of the {411} orientation in the primary recrystallized grains. In other words, when the steel sheet was heated from 570° C. or higher at a rate of 140° C./sec, the fraction of grains having the {411}<148> orientation somewhat increased, but this increase was very low (less than 5%), and it appears that the influence of the growth of the {411}<148> Goss orientation on the exact Goss orientation is not so significant.

On the contrary, in inventive materials 10 and 11, the volume fraction of grains having an orientation of up to 15° from the {110}<001> orientation was 2% or more, and particularly the effect of directly increasing the fraction of grains having the exact Goss orientation was very high. This can be confirmed by the fact that the difference between the inventive material and the comparative material was greater when the tolerance angle (meaning an angle deviating from the Goss orientation {110}<001>) was 5° or less, compared to when the tolerance angle was 15°.

In other words, in inventive materials 10 and 11 which were heated by two-stage rapid heating (ultra-rapid heating from room temperature to 570° C., and then rapid heating from 570 to 700° C.) during primary recrystallization annealing, the fraction of grains having an orientation of up to 5° from the {110}<001> orientation was 0.09% or more, which was very different from the fractions of Goss-oriented grains in comparative materials 26 to 31.

Accordingly, it can be seen that, when the heating conditions of the present invention are applied, the fraction of grains having an orientation very close to the Goss orientation, that is, the exact Goss orientation having a deviation angle of up to 5° from the {110}<001> orientation, significantly increases, and thus nuclei capable of growing into grains having the desired orientation increase, and these grains grow so that the orientation of secondary recrystallized grains is very close to the Goss orientation, thus improving the magnetic properties of the steel sheet, because the Goss-oriented grains in the grain-oriented electrical steel sheet grow even when the amount of the Goss-oriented grains in the primary recrystallized grains is very small.

When the heating rate in the temperature range from 570 to 700° C. after ultra-rapid heating during primary recrystallization annealing is higher than 250° C./sec, the fraction of Goss-oriented grains increases, and the effect of improving the magnetic properties of the steel sheet is not significant, because the number of large grains having a size of 35 μm or larger when observing the cross-section of the steel sheet before secondary recrystallization annealing after primary recrystallization annealing excessively increases (30 or more; comparative material 25), and due to these large grains, grains having orientations other than the Goss orientation, which adversely affect the magnetic properties of the steel sheet, are grown by the size advantage, and thus orientations deviating from the {110}<001> orientation in the final steel sheet product increase.

EXAMPLE 4

A grain-oriented electrical steel sheet slab comprising, by wt %, Si: 3.13%, C: 0.057%, Mn: 0.095%, S: 0.0045% N: 0.0049%, soluble Al: 0.029%, and the balance of Fe and inevitable impurities, was heated at a temperature of 1150° C. for 210 minutes, and then hot-rolled to produce a hot-rolled steel sheet having a thickness of 2.3 mm. The hot-rolled steel sheet was heated to a temperature of 1100° C. or higher, maintained at 910° C. for 90 seconds, quenched in water, pickled, and then cold-rolled to a thickness of 0.30 mm.

The cold-rolled steel sheet was heated in the furnace, and then subjected to simultaneous decarburization and nitrification by maintaining the steel sheet at a temperature of 845° C. for 160 seconds in a mixed gas atmosphere formed by simultaneously adding 74.5% hydrogen, 24.5% nitrogen and 1% dry ammonia gas, and having a dew-point temperature of 65° C. The nitrogen content of the nitrified steel sheet was controlled between 170 ppm and 210 ppm. In the heating process, the steel sheet was heated from room temperature to 570° C. at various rates of 30° C./sec, 110° C./sec and 560° C./sec, and then from 570° C. to 700° C. at various rates of 30° C./sec, 110° C./sec, 140° C./sec, 190° C./sec and 350° C./sec, and then from 700° C. to 845° C. (decarburization annealing temperature) at a rate of 25° C./sec.

The annealing separator MgO was applied to each steel sheet which was then subjected to final annealing in a coiled state. In the final annealing, the steel sheet was maintained in a mixed atmosphere of 25% nitrogen+75% hydrogen until it reached 1200° C., and after the steel sheet reached 1200° C., it was maintained in a 100% hydrogen atmosphere for 10 hours or more, and then cooled in the furnace. Magnetic properties measured for each condition are shown in Table 4 below.

After each specimen was subjected to secondary recrystallization, the area-weighted average of angles deviating from the {110}<001> orientation of grains was measured, and the results of the measurement are shown in Table 4. The measurement was performed based on the X-ray Laue method using an X-ray CCD detector while controlling the position of the detector in units of 1 μm in order to increase the accuracy of the measurement. While the specimen was moved, the orientation at each position of the specimen was measured, and for the orientation measured at each position, the absolute value of the angle deviating from the ideal Goss orientation was calculated, after which the area-weighted average of the deviation angles at all the positions was determined.

TABLE 4

| Rate of heating from room temperature to 570° C. (° C./sec) | Rate of heating from 570 to 700° C. (° C./sec) | Magnetic flux density ($B_{10}$, Tesla) | Core loss ($W_{17/50}$, W/kg) | Area-weighted average of angles deviating from {110}<001> orientation α | β | γ | δ | Remarks |
|---|---|---|---|---|---|---|---|---|
| 30 | 30 | 1.89 | 1.02 | 4.99 | 3.14 | 6.1 | 6.57 | Comparative material 32 |
| 30 | 140 | 1.92 | 0.98 | 4.17 | 2.62 | 5.2 | 5.24 | Comparative material 33 |
| 30 | 350 | 1.91 | 0.99 | 3.89 | 2.84 | 4.52 | 5.27 | Comparative material 34 |
| 560 | 30 | 1.89 | 1.04 | 3.57 | 3.40 | 4.91 | 5.45 | Comparative material35 |
| 560 | 140 | 1.96 | .090 | 3.48 | 2.2 | 3.7 | 4.25 | Inventive material 12 |
| 560 | 190 | 1.95 | 0.91 | 2.77 | 2.37 | 3.48 | 4.01 | Inventive material13 |
| 560 | 350 | 1.92 | 0.99 | 3.56 | 2.94 | 3.99 | 5.05 | Comparative material 36 |
| 110 | 110 | 1.92 | 0.98 | 3.49 | 2.64 | 4.03 | 5.01 | Comparative material 37 |

As can be seen in Table 4 above, in inventive materials 9 and 10 subjected to ultra-rapid heating followed by rapid heating, the area-weighted averages of deviation angles were low as follows: α angle: 3.48° or less, β angle: 1.5-2.4°, γ angle: 3.7° or less, and δ angle: 4.5° or less. Particularly, the area-weighted average of the β angle and the δ angle were rapidly lowered, suggesting that the magnetic properties of the inventive materials were improved. This is related directly to the principle of the present invention according to which magnetic properties are improved. In other words, the width of magnetic domains is minimized by the lowered β angle and δ angle, and thus electromagnetic field energy is minimized while disclosure magnetic domains that adversely affect magnetic properties are minimized.

The invention claimed is:

1. A method for manufacturing a grain-oriented electrical steel sheet, the method comprising:

heating a grain-oriented electrical steel sheet slab; hot-rolling the heated slab; optionally annealing the hot-roiled steel sheet;

subjecting the hot-rolled steel sheet to one cold rolling or two or more cold roilings with intermediate annealing therebetween;

subjecting the cold-rolled steel sheet to primary recrystallization annealing; and subjecting the annealed steel sheet to secondary recrystallization annealing, wherein the primary recrystallization annealing sequentially comprises a first heating process of heating the steel sheet to a temperature, Ts °C., which is below a recrystallization temperature of the steel sheet, at an average heating rate of 300° C./sec or higher, wherein Ts °C. is 500-600° C., a second heating process of heating the steel sheet at a lower average heating rate than the average heating rate of the first heating process, but not lower than 100° C./sec, and a third heating process of heating the steel sheet at a lower average heating rate than the average heating rate of the second heating process.

2. The method of claim 1, wherein the grain-oriented electrical steel sheet comprises, by wt %, Si: 2.0-4.0%, C: 0.085% or less, acid-soluble Al: 0.015-0.04%, Mn: 0.20% or less, N: 0.010% or less, S: 0.010% or less, and the balance of Fe and inevitable impurities.

3. The method of claim 2, wherein the second heating process is performed by heating the steel sheet at an average heating rate of 100~250° C./sec from Ts ° C. to 700° C., and the third heating process is performed by heating the steel sheet at an average heating rate of 40° C./sec or lower from 700° C. to a decarburization annealing temperature.

4. The method of claim 2, wherein the grain-oriented electrical steel sheet has an N content of 0.006 wt % or less, and a process for increasing the content of N in the steel sheet is performed between the cold rolling and the secondary recrystallization annealing.

5. The method of claim 1, wherein the first heating process is performed by heating the steel sheet at an average heating rate of 400° C./sec or higher, the second heating process is performed by heating the steel sheet at an average heating rate of 120~180° C./sec from Ts ° C. to 700° C., and the third heating process is performed by heating the steel sheet at an average heating rate of 40° C./sec or lower from 700° C. to the decarburization annealing temperature.

6. The method of claim 1, wherein the number of grains having a size of 35 μm or larger, measured when observing the cross-section of the steel sheet after the primary recrystallization annealing, but before the secondary recrystallization annealing, is less than 30.

7. The method of claim 1, wherein the grain-oriented electrical steel sheet is heated to 1280° C. or lower before the hot rolling.

8. The method of claim 1, wherein the volume fraction of grains having an orientation of up to 15° from the {110}<001> orientation is 2% or more when measured in a layer corresponding to ⅛ of the thickness from the surface of the steel sheet after the primary recrystallization annealing but before the secondary recrystallization annealing.

9. The method of claim 8, wherein the volume fraction of grains having an orientation of up to 5° from the {110}<001> orientation is 0.09% or more when measured in a layer corresponding to ⅛ of the thickness from the surface of the steel sheet after the primary recrystallization annealing but before the secondary recrystallization annealing.

10. The method of claim 1, wherein β angle as an area-weighted average of an absolute value of crystallographic orientation, measured for the steel sheet after the secondary recrystallization annealing, is controlled in the range of 1.5-2.6°, and a δ angle is controlled to 5° or less, wherein the β angle is an average angle of deviation from the {110}<001> orientation in the direction perpendicular to the rolling direction of the secondary recrystallized texture, and the δ angle is an average angle of deviation between the <001> orientation and the rolling direction in the secondary recrystallized texture.

11. The method of claim 10, wherein the β angle measured for the steel sheet after the secondary recrystallization annealing is controlled to 2.4° or less, and the δ angle is controlled to 4.5° or less.

12. The method of claim 1, wherein the primary recrystallization annealing is performed using a plurality of induction heating furnaces.

13. The method of claim 3, wherein the grain-oriented electrical steel sheet has an N content of 0.006 wt % or less, and a process for increasing the content of N in the steel sheet is performed between the cold rolling and the secondary recrystallization annealing.

14. The method of claim 2, wherein the first heating process is performed by heating the steel sheet at an average heating rate of 400° C./sec or higher, the second heating process is performed by heating the steel sheet at an average heating rate of 120~180° C./sec from Ts ° C. to 700° C., and the third heating process is performed by heating the steel sheet at an average heating rate of 40° C./sec or lower from 700° C. to the decarburization annealing temperature.

15. The method of claim 3, wherein the first heating process is performed by heating the steel sheet at an average heating rate of 400° C./sec or higher, the second heating process is performed by heating the steel sheet at an average heating rate of 120~180° C./sec from Ts °C. to 700° C., and the third heating process is performed by heating the steel sheet at an average heating rate of 40° C./sec or lower from 700° C. to the decarburization annealing temperature.

16. The method of claim 2, wherein the number of grains having a size of 35 μm or larger, measured when observing the cross-section of the steel sheet after the primary recrystallization annealing, but before the secondary recrystallization annealing, is less than 30.

17. The method of claim 3, wherein the number of grains having a size of 35 μm or larger, measured when observing the cross-section of the steel sheet after the primary recrystallization annealing, but before the secondary recrystallization annealing, is less than 30.

18. The method of any one of claim 2, wherein the grain-oriented electrical steel sheet is heated to 1280° C. or lower before the hot rolling.

19. The method of claim 2, wherein the volume fraction of grains having an orientation of up to 15° from the {110}<001> orientation is 2% or more when measured in a layer corresponding to ⅛ of the thickness from the surface of the steel sheet after the primary recrystallization annealing but before the secondary recrystallization annealing.

20. The method of claim 2, wherein a β angle as an area-weighted average of an absolute value of crystallographic orientation, measured for the steel sheet after the secondary recrystallization annealing, is controlled in the range of 1.5-2.6°, and a δ angle is controlled to 5° or less, wherein the β angle is an average angle of deviation from the {110}<001> orientation in the direction perpendicular to the rolling direction of the secondary recrystallized texture, and the δ angle is an average angle of deviation between the <001> orientation and the rolling direction in the secondary recrystallized texture.

* * * * *